US008313300B2

(12) United States Patent
Gerhardt et al.

(10) Patent No.: US 8,313,300 B2
(45) Date of Patent: Nov. 20, 2012

(54) ROTOR FOR CENTRIFUGAL COMPRESSOR

(75) Inventors: Jim Gerhardt, St. Augusta, MN (US); Shannon Hansen, Bird Island, MN (US)

(73) Assignee: Christianson Systems, Inc., Blomkest, MN (US)

( * ) Notice: Subject to any disclaimer, the term of this patent is extended or adjusted under 35 U.S.C. 154(b) by 1108 days.

(21) Appl. No.: 12/156,941

(22) Filed: Jun. 5, 2008

(65) Prior Publication Data

US 2009/0142196 A1 Jun. 4, 2009

Related U.S. Application Data

(60) Provisional application No. 60/934,886, filed on Jun. 14, 2007.

(51) Int. Cl.

| | |
|---|---|
| ***B63H 1/16*** | (2006.01) |
| ***B64C 11/00*** | (2006.01) |
| ***B64C 27/20*** | (2006.01) |
| ***F01D 5/22*** | (2006.01) |
| ***F03D 11/00*** | (2006.01) |

(52) U.S. Cl. ..... 416/186 R; 416/223 R; 416/185; 416/223 B

(58) Field of Classification Search ..... 416/223 R, 416/185, 186 R, 187, 182, 183, 175, 223 B, 416/235

See application file for complete search history.

(56) References Cited

U.S. PATENT DOCUMENTS

| | | | | |
|---|---|---|---|---|
| 2,613,609 | A | 10/1952 | Büchi | |
| 3,069,133 | A * | 12/1962 | Swearingen | 415/175 |
| 4,566,166 | A | 1/1986 | Donelson | |
| 4,666,373 | A | 5/1987 | Sugiura | |
| 4,875,831 | A | 10/1989 | Fetiveau | |
| 5,438,755 | A | 8/1995 | Giberson | |
| 5,605,444 | A | 2/1997 | Paton et al. | |
| 6,062,819 | A | 5/2000 | Zangench et al. | |
| 6,264,429 | B1 | 7/2001 | Koeller et al. | |
| 6,338,610 | B1 | 1/2002 | Harada et al. | |
| 6,340,291 | B1 | 1/2002 | Reckert | |
| 6,494,676 | B2 | 12/2002 | Yokoyama et al. | |
| 6,712,593 | B2 | 3/2004 | Takahashi et al. | |
| 6,715,991 | B2 | 4/2004 | Rossi et al. | |
| 6,729,845 | B2 | 5/2004 | Rossi | |
| 6,739,835 | B2 | 5/2004 | Kim | |
| 6,814,540 | B2 | 11/2004 | Sishtla et al. | |
| 2004/0093727 | A1 | 5/2004 | Mola | |
| 2008/0050228 | A1 * | 2/2008 | Chen et al. | 415/204 |

FOREIGN PATENT DOCUMENTS

| | | |
|---|---|---|
| EP | 0 992 310 A2 | 4/2000 |
| EP | 1 211 009 A1 | 6/2002 |

* cited by examiner

*Primary Examiner* — Toan Le
(74) *Attorney, Agent, or Firm* — Merchant & Gould P.C.

(57) ABSTRACT

The present disclosure provides an improved rotor of a centrifugal compressor. The rotor includes a blade arrangement and geometry that increase the overall efficiency of the rotor. In particular, blades within the rotor are curved and inclined in a manner that improves the overall efficiency of the rotor. The present disclosure also provides a method of manufacturing the improved rotor.

29 Claims, 8 Drawing Sheets

ROTOR FOR CENTRIFUGAL COMPRESSOR

CROSS REFERENCE TO RELATED APPLICATIONS

This application claims the benefit of U.S. Provisional Application Ser. No. 60/934,886, filed Jun. 14, 2007, which application is incorporated herein by reference.

TECHNICAL FIELD

The present invention relates to an improved rotor of a centrifugal compressor and a method for manufacturing a rotor.

BACKGROUND

A centrifugal compressor utilizes rotors, also known as impellers, to impart to a fluid (typically air) the energy necessary to change the pressure of the fluid. The rotor of a common type of centrifugal compressor includes a number of blades, also known as vanes, disposed radially between a doughnut-shaped cap, also known as a shroud, and a circular base, also known as a hub. The blades, cap, and base of such a rotor are arranged to form fluid flow passages within the rotor that converge towards the center of the rotor.

When the above-described rotors are rotated at high speeds, they can generate high pressures and temperatures. These rotors preferably have high rotational and structural stability (e.g., strength, balance), high heat resistance, high efficiency, and also are relatively easy to manufacture. These design constraints are particularly significant as the size of the rotors increases, because the stresses on the rotors increase as the size of the rotors increases.

Attempts have been made to improve the dynamic performance of such rotors by changing the geometry and/or arrangement of the blades within the rotors. For example, U.S. Pat. No. 6,729,845 to Rossi discloses the use of curved blades within the rotor. Attempts have also been made to improve the methods of manufacturing such rotors. For example, U.S. Pat. No. 6,276,899 to Lambert et al. discloses a method of welding together rotor components; U.S. Pat. No. 6,976,828 to Godichon et al. discloses a method of bolting together rotor components; US 2002/0051707 to Takahashi et al. discloses a method of molding a rotor; and U.S. Pat. No. 7,305,762 to Mola and U.S. Pat. No. 6,676,826 to Battistini et al. disclose methods of machining a rotor. Notwithstanding these advances, further improvements in the design, construction, and overall performance of centrifugal compressor rotors are desirable.

SUMMARY

An object of the present disclosure is to provide an improved rotor of a centrifugal compressor. The improved rotor includes a blade arrangement and geometry that increase the overall effectiveness of the rotor. The rotor in some embodiments of the invention includes uniquely shaped curved airfoil blades. In other embodiments the rotor includes a unique arrangement of shorter and longer blades. Another object of the present disclosure is to provide an improved method for production of a rotor involving molding a rotor of a synthetic resin.

DETAILED DESCRIPTION

The principles of the present disclosure are described herein with reference to the figures. Wherever possible, the same reference numbers will be used throughout the drawings to refer to the same or like parts.

Figure 1:
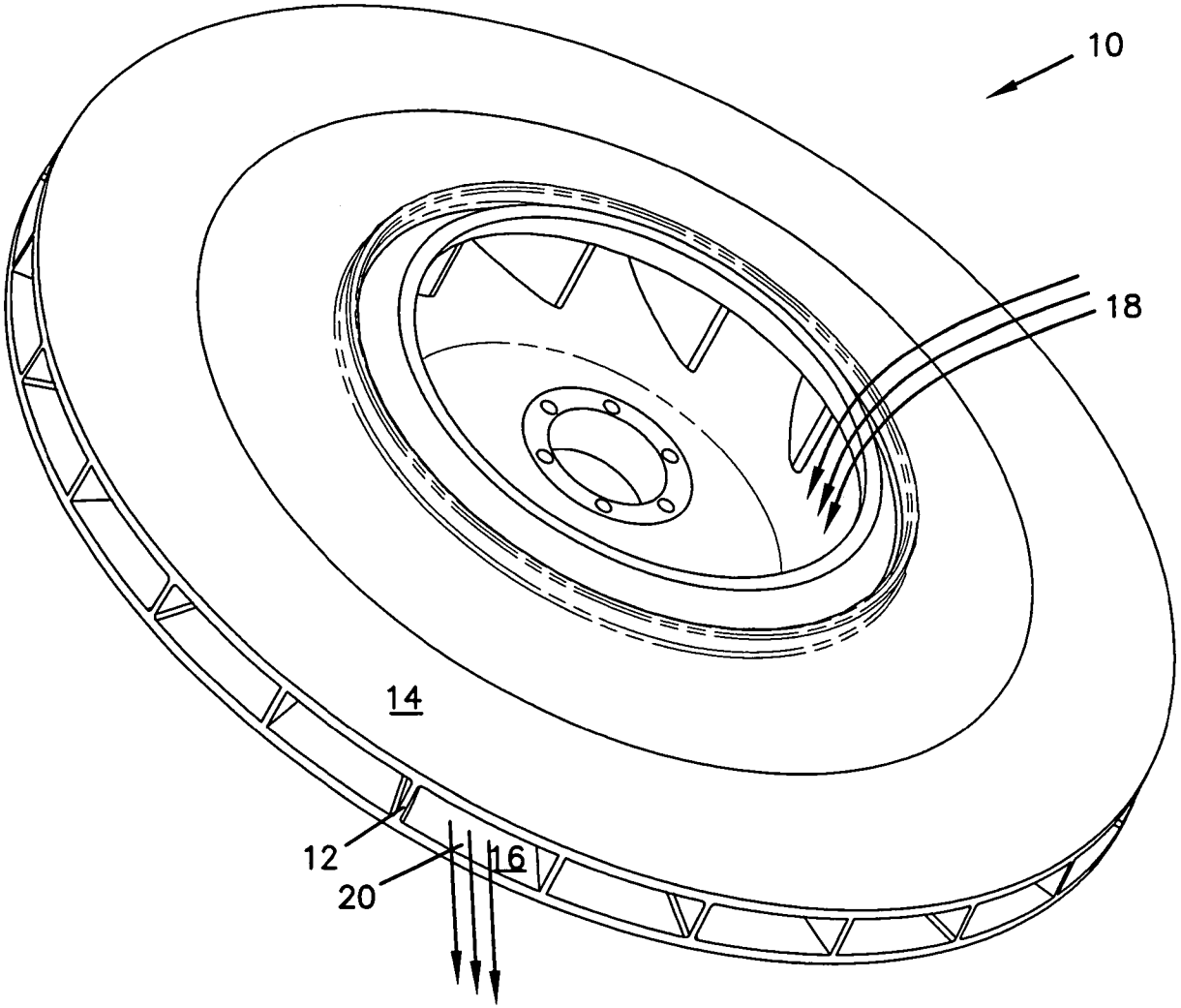
FIG. 1 is a perspective view of an embodiment of a rotor according to the principles of the present invention.

Referring to FIG. 1, a rotor 10 for a centrifugal compressor according to the principles of the present disclosure is shown. The rotor includes a number of blades 12 arranged between a cap 14 and a hub 16. The cap 14 includes a center aperture, which defines an inlet 18 for receiving fluid (e.g., air). The fluid received through the inlet 18 is accelerated by the rotor and discharged through the outlets 20 located along the periphery of the rotor 10.

Referring to FIGS. 2-7, the rotor 10 is shown in the context of industrial sized centrifugal compressors 22, 24. Centrifugal compressors have a wide range of applications (e.g., vacuum systems, transporting natural gas through pipelines, pressurizing cabins of aircrafts, turbo charging engines, compressing fluids in refrigeration, etc.). However, for description purposes, the rotor 10 will be described herein in the context of an industrial sized centrifugal compressor that is configured to be used in a pneumatic conveyor. Pneumatic conveyors are machines that are commonly used to unload grain (and other flowable materials) from storage facilities, trucks, rail cars, barges, large ships, and in-plant applications. Pneumatic conveyors are available from http://www.christianson.com/. It should be understood that alternative embodiments of the rotor of the present disclosure and related method can be used in numerous other types of industrial and non-industrial centrifugal compressors.

Figure 2:
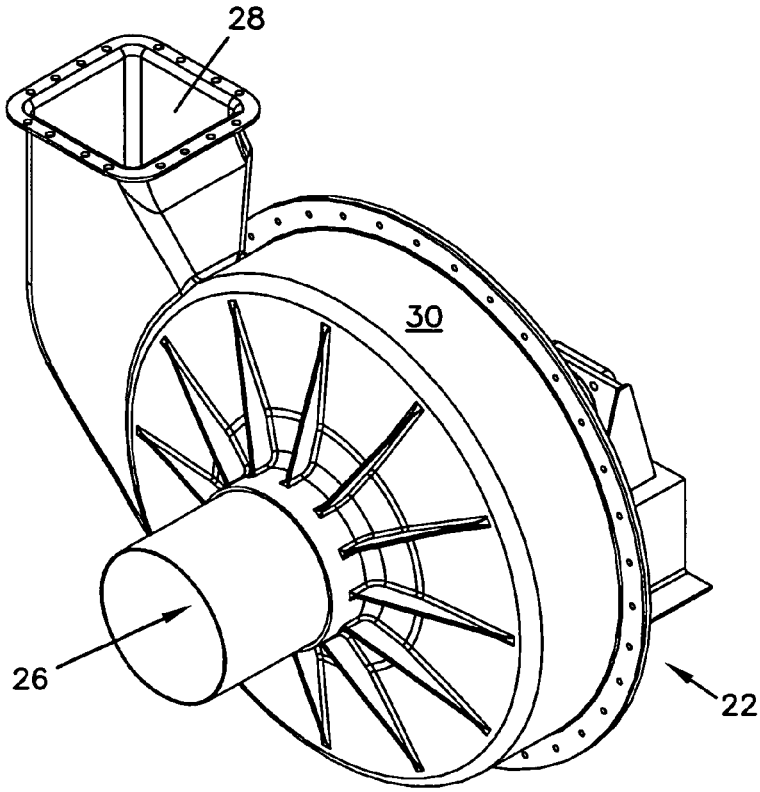
FIG. 2 is a perspective view of a single-stage centrifugal compressor.
Figure 3:
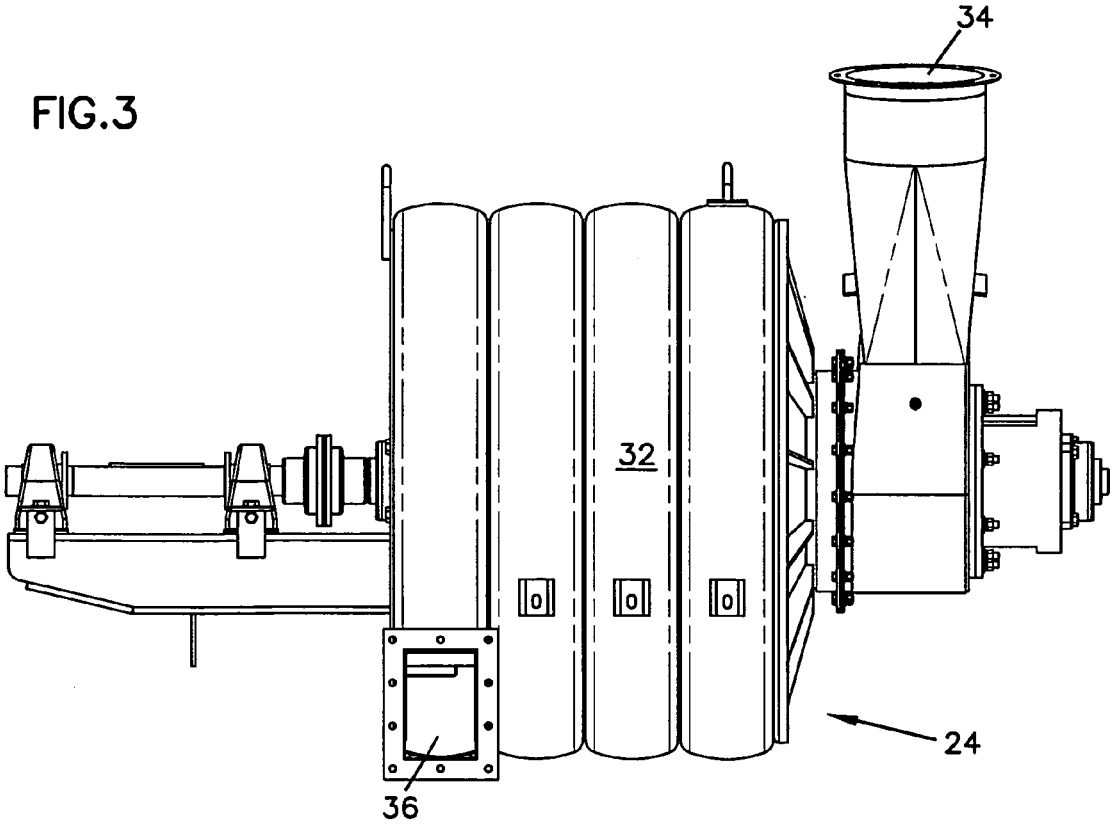
FIG. 3 is a side view of a multi-stage centrifugal compressor.

FIG. 2 is a perspective view of a single-stage centrifugal compressor 22. The single stage compressor 22 includes a body 30 with an intake 26 and a discharge 28. A single rotor 10 is supported within the body 30 of the centrifugal compressor 22. FIG. 3 is a side view of a multi-stage centrifugal compressor 24. The multi-stage centrifugal compressor 24 also includes a body 32 with an intake 34 and a discharge 36. In the depicted embodiment multi-stage centrifugal compressor 24 is a four-stage centrifugal compressor. In other words, four rotors 10 are housed within the body 32. The four rotors 10 are arranged such that they work together to compress fluid that passes through the multi-stage compressor 24. As discussed above, it should be appreciated that many rotor arrangements are possible (e.g., different sizes and geometric configurations). However, for the purposes of this description, the depicted rotor 10 will be described herein with reference to the single-stage centrifugal compressor 22.

Figure 4:
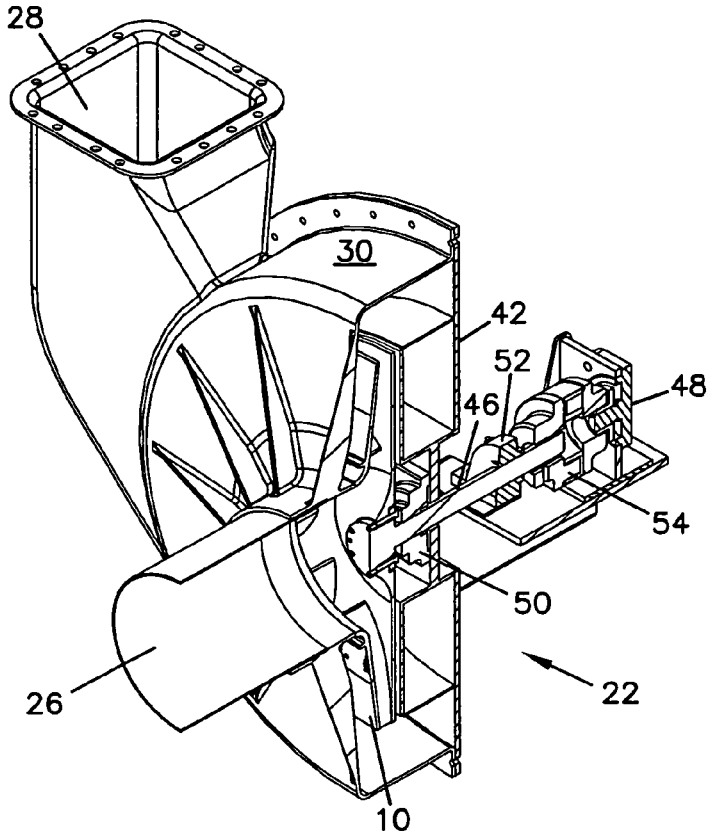
FIG. 4 is a perspective cross-sectional view of FIG. 2 showing the rotor of FIG. 1 within the compressor.
Figure 5:
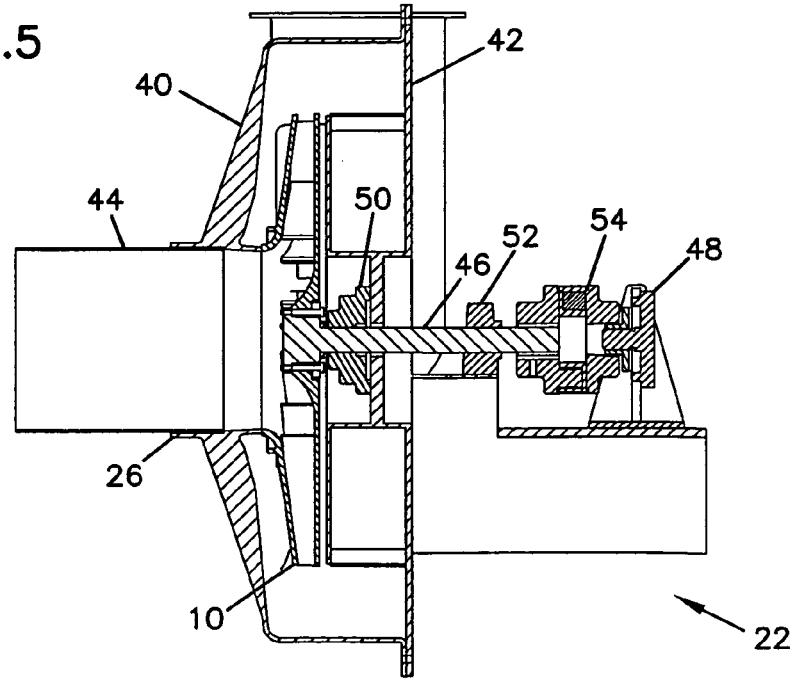
FIG. 5 is a side cross-sectional view of FIG. 2 showing the rotor of FIG. 1 within the compressor.
Figure 6:
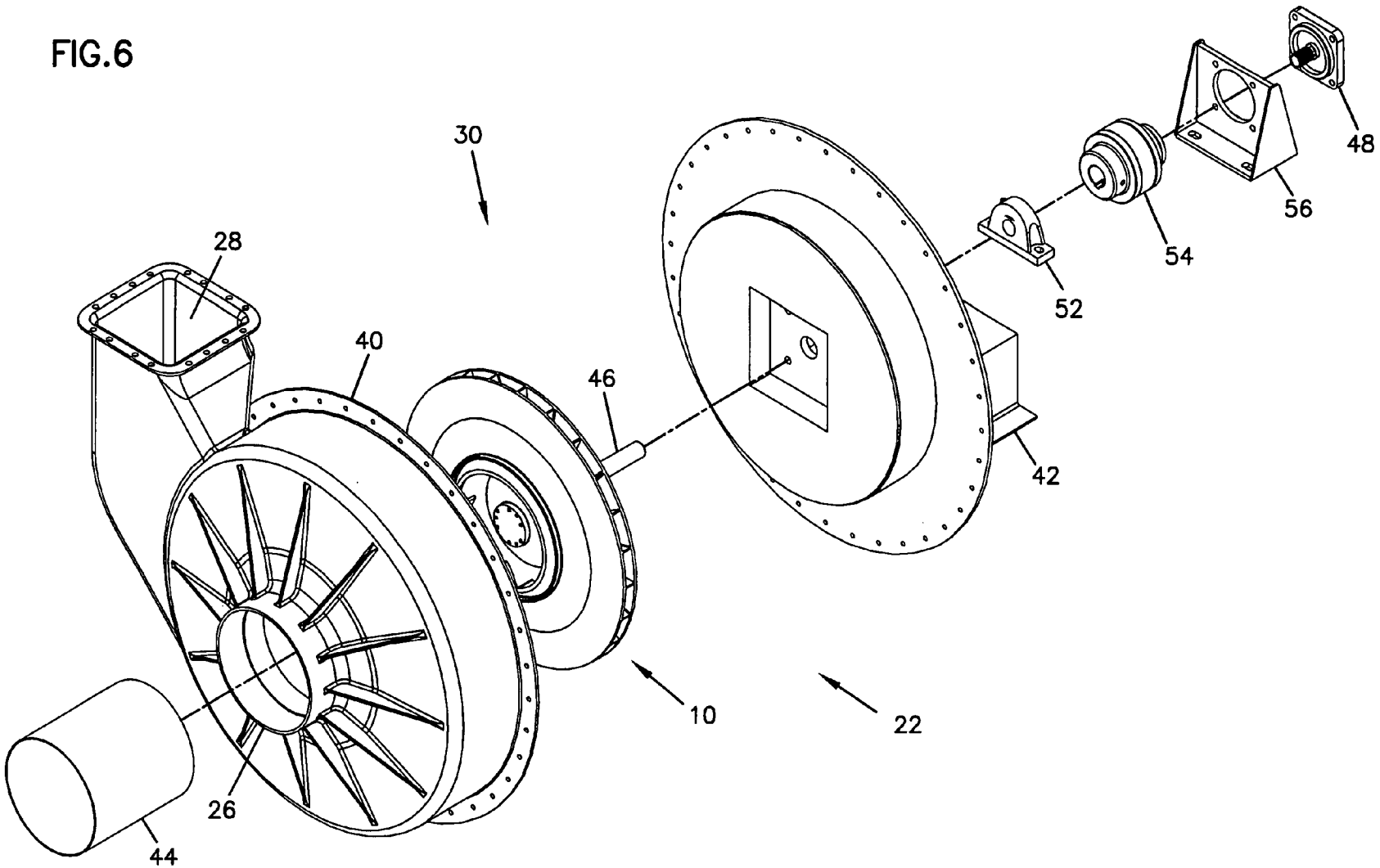
FIG. 6 is an assembly view of the compressor of FIG. 2.

Referring to FIGS. 4-6, the rotor 10 is shown mounted within the single stage centrifugal compressor 22. The body 30 of the single-stage compressor includes a main housing structure 40 and a base 42, which are configured to house the rotor 10. The main housing structure 40 includes an inlet 26 shown attached to an inlet tube 44 which is used to direct fluid into the body 30 of the compressor 22 towards the rotor 10. The main housing structure 40 also includes the fluid outlet 28 for discharging the pressurized fluid. It should be appreciated that the main housing structure 40 can be constructed of any strong material (e.g., metal or composite material).

In the depicted embodiment, the main housing structure 40 is shown bolted to the base 42. The base 42 is configured to support a bearing assembly, which in turn supports the drive shaft 46 that mounts to the rotor 10. The drive shaft 46 connects the rotor 10 to the motor output 48. In the depicted embodiment, the drive shaft 46 bolts to the rotor 10 and is supported by a flange bearing 50, a pillow block bearing 52, and a coupler 54. The flange bearing 50 and pillow block bearing 52 are shown directly mounted to the base 42, and the coupler 54 is supported on the base 42 via a bracket 56. It should be appreciated that alternative configurations of the single-stage compressor 22 are possible.

Still referring to FIGS. 4-6, when the rotor 10 is rotated within the body 30 in a first direction, the fluid (e.g., air) is moved from the inlet 26 to the outlet 28. When the rotor 10 is rotated at high speeds (e.g., 5000 rpm) a pressure differential is created between the inlet 26 and the outlet 28. The pressure differential that can be generated using the rotor 10 of the present disclosure is unexpectedly much greater than the pressure differential that can be generated with prior art rotors driven by a motor with the same horsepower rating. The chart below illustrates the pressures that are generated by the rotor 10 under various conditions.

| HP (horse power) | HG (inches of mercury) | CFM (cubic feet per minute) | PSIA (pounds-force per square inch absolute) | WC (inches of water column) |
|---|---|---|---|---|
| 75 | 23.98 | 3246 | 2.92156 | 325 |
| 100 | 24.12 | 4458 | 2.851666 | 327 |
| 150 | 24.63 | 7285 | 2.60255 | 334 |
| 200 | 25.38 | 10115 | 2.23345 | 344 |
| 250 | 26.38 | 12942 | 1.74495 | 358 |

1 PSI = 27 Inches in WC
14.7 PSI = 408 Inches in WC = 29.29 HG
HG = (WC/27.68)*2.04
WC = (HG/2.04)*27.68

Comparable size centrifugal compressors with prior art rotors generate significantly less pressure when driven by the same size motor at similar speeds. In the typical pneumatic conveyor embodiment the rotor 10 has high tail/tip speeds due to its relatively large size. For example, if the diameter of the rotor is 27 inches at 5000 RPM the tail of the blades have a linear velocity of about 589 ft/sec (27 in*1 foot/12 inches*3.14*1 minute/60 sec*5000 rpm). At 4000 rpm the linear velocity of the tails are about 471 ft/sec.

Finite element analysis (FEA) was used as a tool in the geometric design process of the rotor 10. FEA is a computer simulation technique used in engineering analysis that applies a numerical technique called the finite element method (FEM). The FEA tool was used by the inventors to test the geometry and arrangement of unusual shaped and arranged blades. The geometry of an embodiment of the rotor 10 is described below in further detail.

Figure 7:
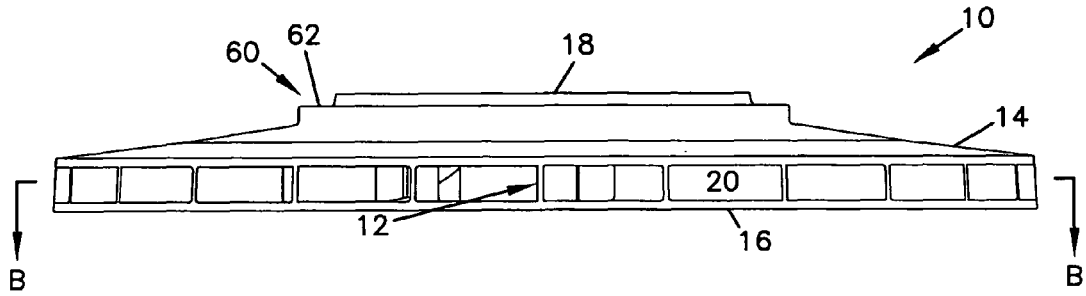
FIG. 7 is a side view of the rotor of FIG. 1.
Figure 8:
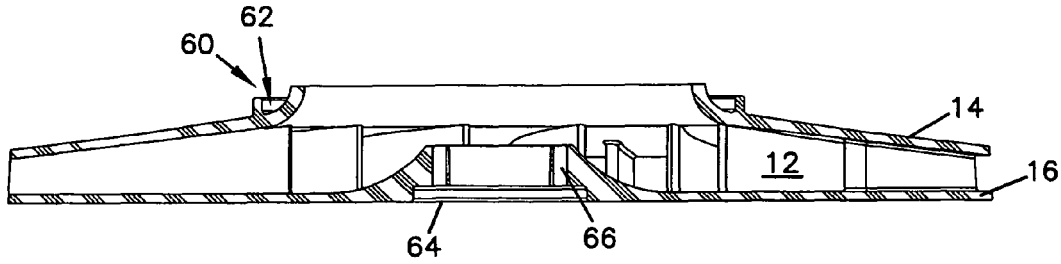
FIG. 8 is a side cross-sectional view of the rotor of FIG. 7.
Figure 9:
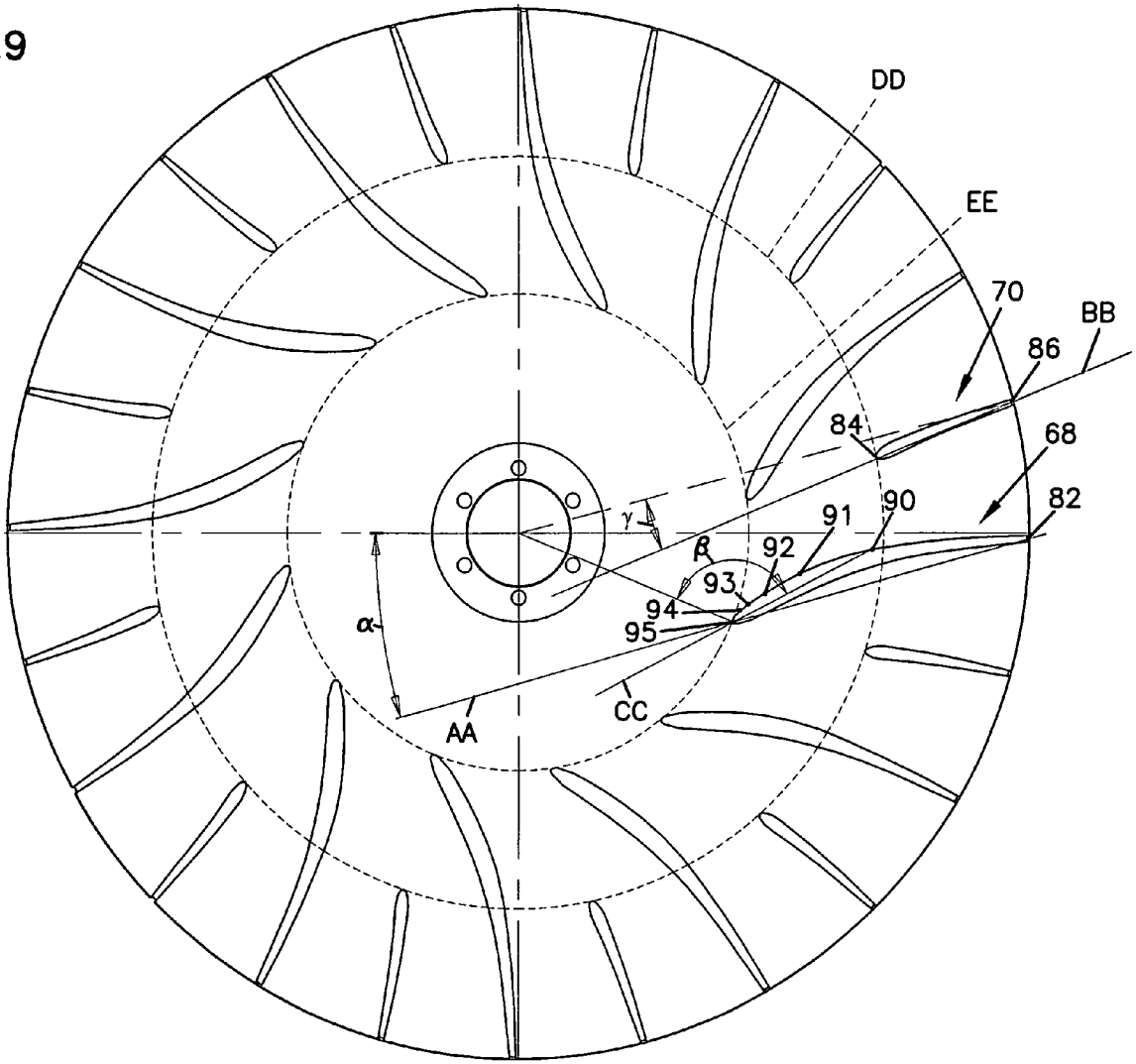
FIG. 9 is a cross-sectional view of the rotor of FIG. 7 along line B-B.

Referring to FIGS. 7-9, the rotor 10 is shown in greater detail. FIG. 7 is a side view of the rotor 10. As discussed above, the rotor includes a number of blades 12 arranged between a cap 14 and a hub 16. The rotor 10 is configured to receive air through the inlet 18 and discharge air through the outlets 20 located along the periphery of the rotor 10.

A seal helps to maintain a pressure differential between the input and the output regions of the rotor 10. More particularly, the cap 14 includes a neck 60 which forms a seal with the intake 26 of the body 30. The neck 60 includes an annular groove 62 shown in FIG. 8, which is a cross-sectional view of the rotor 10 of FIG. 7. The hub 16 includes a central drive shaft mount 64 that includes a recess and holes 66 that are configured to receive a portion of the drive shaft 46. In the depicted embodiment the blades 12 include a set of longer primary blades 68 and shorter secondary blades 70.

In the depicted embodiment, the primary blades 68 are interspersed with secondary blades 70. Both the primary blades 68 and secondary blades 70 generally extend from the periphery edge of the rotor 10 towards the center of the rotor 10. In the depicted embodiment the diameter of the rotor 10 is about 27 inches (R1=13.5 inches) and the diameter of the inlet 18 is about 10 to 11 inches (R2=5 to 5.5 inches). The primary blades 68 extend from the periphery edge to about 5-7 inches from the center of the hub 16, and the secondary blades 70 extend from the periphery edge to about 8-10 inches to the center of the hub 16. More particularly, the twelve secondary blades 70 extend to line DD, which is about 8-9 inches (e.g., 8.5 inches) from the center of the hub 16, and the twelve primary blades 68 extend to line EE, which is about 5-7 inches (e.g., 6 inches) from the center of the hub 16 (i.e., the rotational axis of the rotor 10). In the depicted embodiment the primary and secondary blades 68, 70 are approximately evenly spaced apart on the hub 16. It should be appreciated that alternative embodiments may include more or less blades. For example, one alternative embodiment could include ten blades and another alternative embodiment could include fifteen blades.

In the depicted embodiment, line AA passing through a tip 95 and a tail 82 of a primary blade 68 is disposed at an angle t between about 10-20 degrees from a dashed line shown passing through the tail 82 of the blade 68 and the center of the hub 16. The tip 95 is located on the proximal end of the blade 68 and the tail 82 is located on the distal end of the blade 68. More particularly, the angle $\alpha$ is as shown between about 14-16 degrees. Generally, this configuration may be referred to as an example of a backward inclined configuration. In the depicted embodiment, the line AA passes primarily outside of the primary blade 68 because the primary blade is curved. The angle $\alpha$ describes the orientation of the blade as a whole and not necessarily the orientation of any particular part of the blade 68. Line CC passes through the center of the proximal fourth of the blade and is disposed at an angle $\beta$ between about 120 degrees to about 140 degrees relative to the line passing through the tip 95 of the blade 68 and the center of the hub 16. More particularly, the angle $\beta$ is between about 125 degrees to about 135 degrees.

The line BB passing through the tip 84 and tail 86 of a secondary blade 70 is disposed at an angle $\gamma$ between about 5 degrees to about 10 degrees from a line passing though the center of the hub 16 to the tail 86 of the secondary blade 70. More preferably, the angle $\gamma$ is between about 6 degrees to 8 degrees. In the depicted embodiment the angle $\alpha$ is greater than the angle $\gamma$. In other words, the primary blades 68 are more inclined than the secondary blades 70. Also, angle $\beta+\alpha$ is less than 180 degrees, in other words, the first portion of the primary blade 68 is more inclined than the blade as a whole. It should be appreciated that in alternative embodiments of the invention the above angles can vary outside of the above example ranges.

In the depicted embodiment the profile of one of the primary blades 68 can be described by a line connecting the following Cartesian coordinates of the referenced points, provided first in inches: 90 (9.36, 0.143); 91 (7.450, 1.058); 92 (6.54, 1.555); 93 (6.093, 1.834); 94 (5.875, 1.990); 95 (5.699, 2.302). The polar coordinates of the referenced points in degrees and inches are as follows: 90 (9.36, 2.55°); 91 (7.525, 8.08°); 92 (6.722, 13.37°); 93 (6.363, 16.75°); 94 (6.203, 18.72°); 95 (6.146, 22.00°). The polar coordinates above expressed in terms of R are as follows: 90 (R9.36/13.5, 2.55°); 91 (R7.525/13.5, 8.08°); 92 (R6.722/13.5, 13.37°); 93 (R6.363/13.5, 16.75°); 94 (R6.203/13.5, 18.72°); 95 (R6.146/13.5, 22.00°). In the depicted embodiment the radius R of the rotor is about 13.5 inches. Though the geometry and layout of a primary and secondary blade 68, 70 are described in particular detail herein, it should be appreciated that many other blade configurations and arrangements are also possible. For example, in an alternative embodiment the R coordinates at the various angles might vary by +/−0.04 or more. More preferably, the R coordinates might vary by +/−0.02 or less. The numerical value for R itself may also vary. For example, in some embodiments the R value is between about 11-15 inches, and in other embodiments the R value is between about 12-14 inches.

Figure 10:
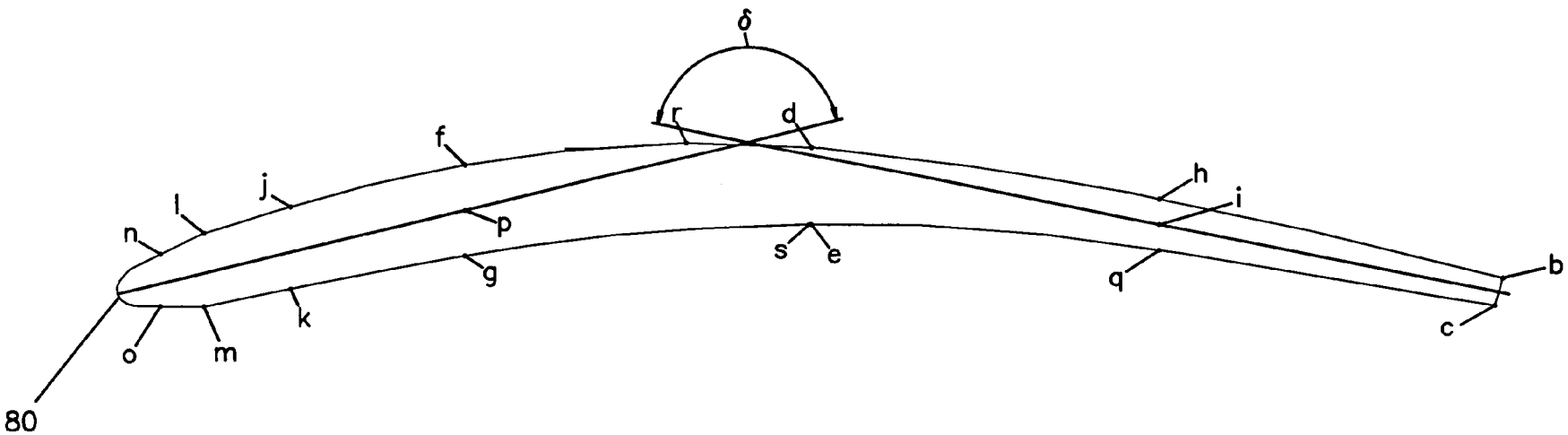
FIG. 10 is a cross-sectional view of a primary blade of the rotor of FIG. 7.

Referring to FIG. 10, the geometry of a primary blade 68 is shown in greater detail. The blade geometry is described herein with reference to an upper curve (line 80-*b*) and a lower curve (line 80-*c*). Generally, the blade geometry may be referred to as an example of a blade that bears similarity to an airfoil. In FIG. 10, the tip 80 of the primary blade 68 has been oriented over point (0.0,0.0) on a Cartesian coordinate system, and the midpoint of the tail end of the blade 68 (i.e., the point between points b and c) has been oriented on the X axis. The chart below provides the approximate coordinates for the referenced points. The coordinates are provided in inches and dimensionless as a function of L, wherein L is the distance between the tip 80 and tail end of the primary blade 68.

| Reference | X (L) | X (inches) | Y (L) | Y (inches) |
|---|---|---|---|---|
| 80 | 0 | 0 | 0L | 0 |
| b | L | 8.081 | 0.00965L | 0.078 +/− 30% |
| c | L | 8.081 | −0.00965L | −0.078 +/− 30% |
| d | L/2 | 4.040 | 0.10345L | 0.836 +/− 30% |
| e | L/2 | 4.040 | 0.04925L | 0.398 +/− 30% |
| f | L/4 | 2.020 | 0.09045L | 0.731 +/− 30% |
| g | L/4 | 2.020 | 0.02710L | 0.219 +/− 30% |
| h | 3L/4 | 6.061 | 0.06694L | 0.541 +/− 30% |
| i | 3L/4 | 6.061 | 0.03068L | 0.248 +/− 30% |
| j | L/8 | 1.010 | 0.06138L | 0.496 +/− 30% |
| k | L/8 | 1.010 | 0.00371L | 0.030 +/− 30% |
| l | L/16 | 0.505 | 0.04282L | 0.346 +/− 30% |
| m | L/16 | 0.505 | −0.008786L | −0.071 +/− 30% |
| n | L/32 | 0.253 | 0.03143L | 0.254 +/− 30% |
| o | L/32 | 0.253 | −0.009405L | −0.076 +/− 30% |
| p | L/4 | 2.020 | 0.05878L | 0.475 +/− 30% |
| q | 3L/4 | 6.061 | 0.04889L | 0.395 +/− 30% |
| r | 0.4102L | 3.315 | 0.10642L | 0.860 +/− 30% |
| s | 0.4981L | 4.025 | 0.00493L | .0399 +/− 30% |

With the exception of points p and q, all the above points are along the upper and lower curves that define the geometry of the depicted primary blade 68. Points p and q are used to define the lines bisecting the end portions of the primary blade 68. It should be appreciated that the above coordinates describe a particular geometry that can vary in alternative embodiments of the invention. For example, in an alternative embodiment of the invention one or more of the Y coordinates might vary by as much as 30 percent or even more. For example, the Y coordinates at reference b can be between about 0.0546-0.1014 (i.e., 0.078−0.3*0.078 and 0.078+0.3*0.078), more preferably, the Y coordinates vary 10 percent or less. The L value can also vary. For example, in some embodiments the L value is between 6-10 inches. In other example embodiments the L value is between 7-9 inches. It should be appreciated that in alternative embodiments of the invention, the above coordinates and L values can vary even outside of the above example ranges.

In the depicted embodiment the angle δ is the angle defined between the line that bisects the front and rear portions of the primary blade 68. The line that bisects the front of the blade passes through point 80 and point p, and the line that bisects the rear portions of the blade passes through the end of the primary blade between points b and c and through point q. The point q is ¾ the length of the blade and approximately midway between points h and i (vertically). Similarly, point p is ¼ the length of the blade and approximately midway between points f and g (vertically). As included in the chart below, the angle δ in the depicted embodiment is about 155.72°. It should be appreciated that in alternative embodiments the angle δ may be greater than or less than 155.72°. For example, the angle δ may in some embodiments range from 145-165 degrees.

| References | Measures |
|---|---|
| δ_the angle defined between the line that bisects the front and rear ends of the primary blade | 155.72° |
| Distance along line 80-b | 8.3792 inches (1.037L) |
| Distance along line 80-c | 8.1754 inches (1.012L) |
| Distance along line 80-r (where r is the point of inflection on line 80-b) | 3.5183 inches (0.435L) |
| Distance along line 80-s (where s is the point of inflection on line 80-c) | 4.1100 inches (0.509L) |

The above chart compares the length of the upper curve (line 80-*b*) and the lower curve (line 80-*c*). The upper curve is longer than the lower curve. In the depicted embodiment, the length of the upper curve (line 80-*b*) is about 102 percent longer than the length of the lower curve (line 80-*c*). The above chart also describes the relative lengths of the curves in terms of L, which, as discussed above, is the distance between the tip 80 and tail end of the primary blade 68. The chart above also provides data describing how and where blades 68 bend. In the depicted embodiment the inflection point (i.e., the point where the slope changes) of the upper curve is forward (towards the tip) in comparison to the inflection point of the lower curve. The location of the inflection point of the upper curve is about $^{3.5183}/_{8.3792}$ (0.42) towards the front end of the upper curve, whereas the location of the inflection point of the lower curve is about midway at about $^{4.1100}/_{8.1754}$ (0.50) of the length of the lower curve. It should be appreciated that in alternative embodiments of the invention the data can vary even outside of the above example ranges.

Figure 11:
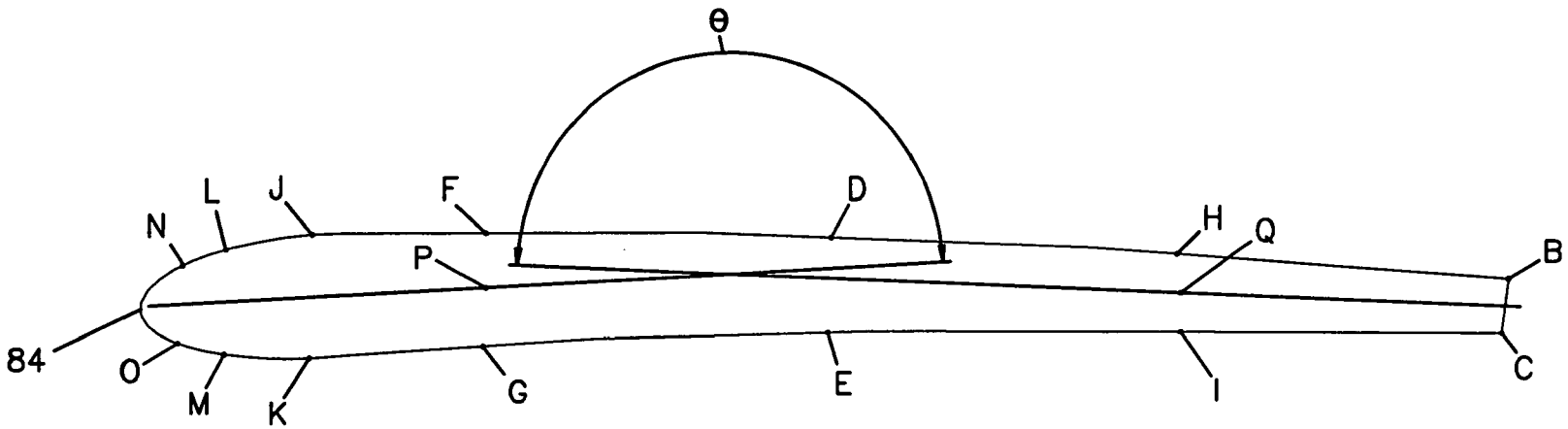
FIG. 11 is a cross-sectional view of a secondary blade of the rotor of FIG. 7.

Referring to FIG. 11, the geometry of a secondary blade 70 is shown in greater detail. The blade geometry is described by an upper curve (line 84-B) and a lower curve (line 84-C). Generally, the geometry may be referred to as an example of an airfoil geometry. In FIG. 11, the tip 84 of the secondary blade 68 has been positioned over point (0.0,0.0) on a Cartesian coordinate system, and the midpoint of the tail end of the blade 70 (i.e., the point between points B and C) has been positioned on the X axis. The chart below provides the approximate coordinates for the referenced points. The coordinates are provided in inches and dimensionless as a function of LL, wherein LL is the distance between the tip 84 and tail end of the primary blade 70. It should be appreciated that in alternative embodiments of the invention the above coordinates and LL values can vary. For example, in an alternative embodiment of the invention one or more of the Y coordinates might vary by as much as 30 percent or even more.

| Reference | X (LL) | X (inches) | Y (LL) | Y (inches) |
|---|---|---|---|---|
| 84 | 0 | 0 | 0LL | 0 |
| B | LL | 3.869 | 0.0189LL +/− 30% | 0.073 |
| C | .998LL | 3.861 | −0.0189LL +/− 30% | −0.073 |
| D | LL/2 | 1.935 | 0.0050LL +/− 30% | 0.0195 |
| E | LL/2 | 1.935 | −0.0180LL +/− 30% | −0.070 |
| F | LL/4 | 0.967 | 0.0535LL +/− 30% | 0.207 |
| G | LL/4 | 0.967 | −0.0264LL +/− 30% | −0.102 |
| H | 3LL/4 | 2.902 | 0.0383LL +/− 30% | 0.148 |
| I | 3LL/4 | 2.902 | −0.0178LL +/− 30% | −0.069 |
| J | LL/8 | 0.484 | 0.0051LL +/− 30% | 0.198 |
| K | LL/8 | 0.484 | −0.0036LL +/− 30% | −0.141 |
| L | LL/16 | 0.242 | 0.0406LL +/− 30% | 0.157 |
| M | LL/16 | 0.242 | −0.0341LL +/− 30% | −0.132 |
| N | LL/32 | 0.121 | 0.0292LL +/− 30% | 0.113 |
| O | LL/32 | 0.121 | −0.0276LL +/− 30% | −0.107 |
| P | LL/4 | 0.967 | 0.0137LL +/− 30% | 0.053 |
| Q | 3LL/4 | 2.902 | 0.0101LL +/− 30% | 0.039 |

With the exception of points P and Q, all the above points are along the upper and lower curves that define the geometry of the secondary blade 70. Points P and Q are to define the lines bisecting the end portions of the secondary blade 70. In the depicted embodiment the angle θ is the angle defined between the line that bisects the front and rear portions of the secondary blade 70. The line that bisects the front of the blade passes through point 84 and point P, and the line that bisects the rear portions of the blade passes through the end of the secondary blade between points B and C and through point Q. The point Q is ¾ the length of the blade and approximately midway between points H and I (vertically). Similarly, point P is ¼ the length of the blade and approximately midway between points F and G (vertically). As included in the chart below, the angle θ in the depicted embodiment is about 174.56°, which indicates that the blade is almost straight (straight would be 180°). It should be appreciated that in alternative embodiments of the invention the angle θ, the angle defined between the line that bisects the front and rear ends of the secondary blade values, can vary. In the depicted embodiment the secondary blades 70 are straighter than the primary blades 68. The secondary blade 70 is about 48% percent ($^{3.896}/_{8.081}$) the length of the primary blade 68. As discussed above, though precise numerical values and ratios have been referenced in the description of the blades, it should be appreciated that the values and ratios are not meant to be absolute and limiting. Alternative embodiments of the invention may include numerous modifications to the above provided blade geometries.

The rotor 10 in one embodiment is molded from a synthetic resin. In one embodiment the resin used is commonly referred to as a Neat Resin. The Neat Resin can be, for example, RTM VE441 OFG which has a tensile strength of 13,000 psi, flexural strength of 24,000 psi, flexural modulus of 510,000 psi, and heat distortion temperature at 264 psi of 245 degrees F. For high temperature environments the Neat Resin can be, for example, RTM EP8606 OFG which has a tensile strength of 9,300 psi, flexural strength of 15,000 psi, flexural modulus of 390,000 psi, and Glass Transition Temperature of 344 degrees F. The rotor 10 can be molded as one piece by using a wax core molding process. The process involves using a first mold to form a wax core in the shape of the empty space inside the rotor 10. Fibers are then placed into a second mold around the wax core, wherein the second mold is in the shape of the outer surfaces of the rotor 10. Subsequently, resin is injected into the second mold to impregnate the fibers therein. After the resin is cured, the wax core is melted out from within the rotor 10.

The above specification, examples, and data provide a complete description of the manufacture and design of a rotor embodying the principles of the present disclosure. Since many alternative embodiments of the invention can be made without departing from the spirit and scope of the invention, the invention resides in the claims hereinafter appended.

We claim:

1. A rotor for a compressor comprising:

a cap, wherein the cap includes a periphery edge spaced at a generally constant distance from a central rotational axis of the rotor and wherein the cap includes a central inlet;

a base, the base including a periphery edge spaced at a generally constant distance from the rotational axis of the rotor; and a plurality of blades extending between the base and the cap, each blade including a tail positioned closer to the periphery edge of the cap and a tip positioned closer to the central inlet;

wherein at least one of the plurality of blades is positioned such that a line passing through the tip of the blade and the tail of the blade is inclined at an angle between about 10-20 degrees with a line passing through the rotational axis of the rotor and the tail of the blade, wherein the rotor comprises a plurality of secondary blades and a plurality of primary blades, wherein the secondary blades are positioned between the primary blades, and wherein the primary blades are longer than the secondary blades, and wherein the rotor includes between ten to fifteen primary blades and ten to fifteen secondary blades.

2. The rotor of claim 1, wherein the primary blades and secondary blades extend from adjacent the periphery edge of the cap towards the inlet.

3. The rotor of claim 1, wherein the primary blades are more curved than the secondary blades.

4. The rotor of claim 1, wherein the primary blades are more inclined than the secondary blades.

5. The rotor of claim 1, wherein a line passing through a tip and a tail of a secondary blade is inclined at an angle between about 6 to 8 degrees relative to a line passing through the rotational axis of the rotor and the tail of the secondary blade.

6. The rotor of claim 1, wherein at least one of the plurality of blades includes a proximal end portion and a distal end portion, wherein the proximal end portion is closer to the central inlet and the distal end portion is closer to the periphery edge of the cap, wherein a line passing generally through the center of the proximal end portion is inclined at an angle between about 125 to 135 degrees relative to a line passing through the rotational axis of the rotor and the tip of the blade.

7. The rotor of claim 1, wherein at least one of the plurality of blades includes a proximal end portion and a distal end portion, wherein the proximal end portion is closer to the central inlet and the distal end portion is closer to the periphery edge of the cap, wherein a line passing through the center of the proximal end portion is inclined at an angle δ between 145-165 degrees relative to a line passing through the distal end portion of the blade.

8. A rotor for a centrifugal compressor comprising:

a cap, wherein the cap includes a periphery edge spaced at a generally constant distance from a central rotational axis of the rotor and wherein the cap includes a central inlet;

a base, the base including a periphery edge spaced at a generally constant distance from the rotational axis of the rotor; and a plurality of blades extending between the base and the cap, each blade including a tip positioned closer to the periphery edge of the cap and a tail positioned closer to the central inlet;

wherein at least one of the plurality of blades includes a proximal end portion and a distal end portion, wherein the proximal end portion is closer to the central inlet and the distal end portion is closer to the periphery edge of the cap, wherein a line passing through the center of the proximal end portion is inclined at an angle δ between 145-165 degrees relative to a line passing through the distal end portion of the blade, wherein the cross-sectional shape of the blades can generally be fit within a zone defined between an upper curve connecting the following Cartesian coordinates: a, n, l, j, f, d, h, b and a lower curve connecting the following Cartesian coordinates: a, o, m, k, g, e, i, c, wherein the coordinates are expressed in terms of L which is approximately the linear distance between points a and b:

| Reference | X (L) | Y (L) |
|---|---|---|
| a | 0 | 0L |
| b | L | 0.00965L +/− 30% |
| c | L | −0.00965L +/− 30% |
| d | L/2 | 0.10345L +/− 30% |
| e | L/2 | 0.04925L +/− 30% |
| f | L/4 | 0.09045L +/− 30% |
| g | L/4 | 0.02710L +/− 30% |
| h | 3L/4 | 0.06694L +/− 30% |
| i | 3L/4 | 0.03068L +/− 30% |
| j | L/8 | 0.06138L +/− 30% |
| k | L/8 | 0.00371L +/− 30% |
| l | L/16 | 0.04282L +/− 30% |
| m | L/16 | −0.008786L +/− 30% |
| n | L/32 | 0.03143L +/− 30% |
| o | L/32 | −0.009405L +/− 30%. |

9. The rotor of claim 8, wherein the cross-sectional shape of the blades can be fit within a zone defined between an upper curve connecting the following Cartesian coordinates: a, n, l, j, f, d, h, b and a lower curve connecting the following Cartesian coordinates: a, o, m, k, g, e, i, c, wherein the coordinates are expressed in terms of L which is approximately the linear distance between points a and b:

| Reference | X (L) | Y (L) |
|---|---|---|
| a | 0 | 0L |
| b | L | 0.00965L +/− 10% |
| c | L | −0.00965L +/− 10% |
| d | L/2 | 0.10345L +/− 10% |

-continued

| Reference | X (L) | Y (L) |
|---|---|---|
| e | L/2 | 0.04925L +/− 10% |
| f | L/4 | 0.09045L +/− 10% |
| g | L/4 | 0.02710L +/− 10% |
| h | 3 L/4 | 0.06694L +/− 10% |
| i | 3 L/4 | 0.03068L +/− 10% |
| j | L/8 | 0.06138L +/− 10% |
| k | L/8 | 0.00371L +/− 10% |
| l | L/16 | 0.04282L +/− 10% |
| m | L/16 | −0.008786L +/− 10% |
| n | L/32 | 0.03143L +/− 10% |
| o | L/32 | −0.009405L +/− 10%. |

10. The rotor of claim 8, wherein L is between 6-10 inches.

11. The rotor of claim 10, wherein L is between 7-9 inches.

12. A rotor for a compressor comprising:

a base, the base including a periphery edge spaced a distance R1 from a center of the base;

a cap, the cap including a periphery edge spaced a distance R2 from a center of the cap, wherein the difference between R1 and R2 varies by less than 10 percent and wherein the center of the cap includes a circular opening; and a plurality of curved blades extending between the base and the cap, wherein at least one curve connecting the following coordinates: (0.69R+/−0.04R, 2.55°+/−0.05°, (0.56R+/−0.04R, 8.08°+/−0.05°, (0.48R+/−0.04R, 13.37°+/−0.05°, (0.50R+/−0.04R, 16.75°+/−0.05°, (0.46R+/−0.04R, 18.72°+/−0.05°, and (0.46R+/−0.04R, 22.00°+/−0.05° falls within the cross-section of the blade.

13. The rotor of claim 12, wherein at least one curve connecting the following coordinates: (0.69R+/−0.02, 2.55°), (0.56R+/−0.02, 8.08°), (0.48R+/−0.02, 13.37°), (0.50R+/−0.02, 16.75°), (0.46R+/−0.02, 18.72°), and (0.46R+/−0.02, 22.00°) falls within the cross-section of the blade.

14. The rotor of claim 12, wherein R is between 11-15 inches.

15. The rotor of claim 14, wherein R is between 13-14 inches.

16. A rotor for a compressor comprising:

a cap, wherein the cap includes a periphery edge spaced at a generally constant distance from a central rotational axis of the rotor and wherein the cap includes a central inlet;

a base, the base including a periphery edge spaced at a generally constant distance from the rotational axis of the rotor; and a plurality of blades extending between the base and the cap, each blade including a tip positioned closer to the periphery edge of the cap and a tail positioned closer to the central inlet;

wherein the base, cap, and blades comprise a one-piece synthetic resin construction.

17. The rotor of claim 16, wherein the rotor is configured to rotate at speeds in excess of 470 feet per second measured at the distal ends of the blades.

18. The rotor according to claim 16, wherein the synthetic resin is a Neat Resin.

19. The rotor according to claim 16, wherein at least one of the blades includes a reversed inclined geometry.

20. The rotor according to claim 16, wherein at least one of the blades includes an airfoil geometry.

21. The rotor according to claim 16, wherein the plurality of blades includes a first set of blades and a second set of blades, wherein the tips of the first set of blades are further from the central inlet than the tips of the second set of blades.

22. The rotor according to claim 21, wherein tips of the first set of blades are about 8-9 inches from the rotational axis of the rotor, and wherein the tips of the second set of blades are about 5.5-6.5 inches from the rotational axis of the rotor.

23. The rotor according to claim 16, wherein the plurality of blades includes a first set of blades and a second set of blades wherein the tips of the first set of blades are further from the central inlet than the tips of the second set of blades.

24. A method of compressing air comprising the steps of:

providing a rotor including:

a cap, wherein the cap includes a periphery edge spaced at a generally constant distance from a central rotational axis of the rotor and wherein the cap includes a central inlet;

a base, the base including a periphery edge spaced at a generally constant distance from the rotational axis of the rotor; and a plurality of blades extending between the base and the cap, each blade including a tip positioned closer to the periphery edge of the cap and a tail positioned closer to the central inlet;

wherein the base, cap, and blades comprise a one-piece synthetic resin construction;

rotating the rotor such that the linear velocity of at least one of the tails of a blade is in excess of 470 feet per second.

25. The rotor according to claim 24, wherein the synthetic resin is a Neat Resin.

26. The rotor according to claim 24, wherein at least one of the blades includes a reversed inclined geometry.

27. The rotor according to claim 24, wherein the plurality of blades includes a first set of blades and a second set of blades, wherein the tips of the first set of blades are further from the central inlet than the tips of the second set of blades.

28. The rotor according to claim 27, wherein tips of the first set of blades are about 8-9 inches from the rotational axis of the rotor, and wherein the tips of the second set of blades are about 5.5-6.5 inches from the rotational axis of the rotor.

29. The rotor according to claim 24, wherein at least one of the blades includes an airfloil geometry.

* * * * *

UNITED STATES PATENT AND TRADEMARK OFFICE

CERTIFICATE OF CORRECTION

PATENT NO. : 8,313,300 B2
APPLICATION NO. : 12/156941
DATED : November 20, 2012
INVENTOR(S) : Gerhardt et al.

It is certified that error appears in the above-identified patent and that said Letters Patent is hereby corrected as shown below:

In the Specifications:

Col. 4, line 43: "t between about 10-20 degrees" should read -- α between about 10-20 degrees --

Signed and Sealed this
Fourteenth Day of May, 2013

Teresa Stanek Rea
*Acting Director of the United States Patent and Trademark Office*